US006109560A

United States Patent [19]

Siegel

[11] Patent Number: 6,109,560

[45] Date of Patent: Aug. 29, 2000

[54] EQUIPMENT TO ROLL-UP A LANE OF COMPRESSIBLE MATERIAL

[75] Inventor: Werner Siegel, Osthofen, Germany

[73] Assignee: Kaibel & Sieber GmbH, Worms am Rhein, Germany

[21] Appl. No.: 08/780,521

[22] Filed: Jan. 8, 1997

[30] Foreign Application Priority Data

Mar. 16, 1996 [DE] Germany ..... 296 04 901 U

[51] Int. Cl.[7] ..... B65H 18/14

[52] U.S. Cl. ..... 242/541.2; 242/541.3; 242/535.1; 242/535.2; 100/88; 100/89

[58] Field of Search ..... 242/541.2, 541.3, 242/535.1, 535.4; 100/76, 88, 89

[56] References Cited

U.S. PATENT DOCUMENTS 3,991,538 11/1976 Finn et al. ..... 242/541.2 X
4,765,554 8/1988 Tuffal et al. ..... 242/541.2 X
5,305,963 4/1994 Harvey, III et al. ..... 242/535.1
5,425,512 6/1995 Bichot et al. ..... 242/541.2 X

FOREIGN PATENT DOCUMENTS 0 734 985 A1 3/1996 European Pat. Off. .

*Primary Examiner*—Donald P. Walsh
*Assistant Examiner*—William A. Rivera
*Attorney, Agent, or Firm*—Gardner, Carton & Douglas

[57] ABSTRACT

An apparatus to roll-up a lane of compressible material includes a first endless conveyor belt, a second endless conveyor belt that forms an angle of between 50° and 80° with the first belt, a winding roller that, with the first and second belts, form a winding space, and a third endless conveyor belt between the first and second belt. The third belt includes a guide plate above the upper portion and the lower portion runs in the same direction and at the same speed as the first belt.

11 Claims, 3 Drawing Sheets

EQUIPMENT TO ROLL-UP A LANE OF COMPRESSIBLE MATERIAL

BACKGROUND OF THE INVENTION

1. Field of the Invention

The invention deals with equipment to roll-up a lane of compressible material in which three winding elements form the winding space. The winding elements include a first continuous conveyor belt to feed the lane of material, a second endless belt that forms an angle of 50° to 80° with the first endless belt, and a winding roller arranged between the conveyor belts. At least one of these winding elements is moveable to the other elements.

In the preferred embodiment, the winding roller is mostly arranged moveable to the other elements and particularly at the end of the winding arm. In this arrangement, the contact pressure between the elements is calculated to shape a round roll and not to deform or crush the roll.

2. Scope of the Prior Art

A piece of equipment is known which provides a third endless conveyor belt between the winding roller and the first endless belt. The third endless conveyor belt belongs to the winding space and its task is to maintain the tension and compression in the roll of compressible material and to prevent expansion. With the third belt, a greater compression of the material is attained therefore when rolling up the material. In other words, more material is wound at same wind diameter and greater length of mat or strip can be rolled-up as compared to two conveyor belt rolling equipment.

The compression of the wound material is determined by the contact pressure of the winding roller. There are, however, limits to the compression as the compressible material is only compressed when it comes into contact with the roll of compressible material formed on the roller. Thereby, the compression area is so short and the surface of the compressible material blanket may be pressed back at too high compression so that under certain circumstances the material may be shorn. The structure of the compressible material is then damaged to such an extent that upon use at construction site the material no longer is able to recover its original elasticity.

In order to obtain greater precompression without damaging the structure and the elastic recovery features, a compression plate, which can compress the compressible material equally over a longer stretch, has been provided beneath the third endless belt in the known equipment. The considerable disadvantage of this device is that friction arises between the surface of the compressible material and the plate. The friction causes the upper side of the compressible material to lag behind the lower side when drawing into the winding space. The compressible material thus suffers from a certain shear stress. This leads to a partial destruction of the fiber structure and influences the later elastic recovery of the material. In the case of laminated products, this can lead to a separation of the lamination from the beginning of the blanket.

SUMMARY OF THE INVENTION

The principle of the invention is to develop a piece of equipment in the manner mentioned initially so that the material is compressed optimally without affecting the material's elastic recovery features.

This task is solved by the invention having a third endless conveyor belt arranged over the first endless conveyor belt.

The lower portion of the third endless conveyor belt runs in the same direction and at the same speed as the upper portion of the first endless conveyor belt. The lower portion of the third endless conveyor and the upper portion of the third continuous conveyor belt narrow to a V-shaped form towards the winding space. The invention also has a guide plate provided above the upper belt of the third endless conveyor belt. The third endless conveyor belt is continuously moved away by the winding arm together with the guide plate as the roll diameter increases. A body can be provided between the upper and lower portions of the third endless conveyor belt.

It is an advantage of the present invention for a tongue of the guide plate to be provided which is parallel to the upper portion of the first endless conveyor belt and for the tongue to protrude into the winding space.

A further advantage is provided if the third endless conveyor belt is perforated.

An additional advantage is provided if body is provided as a hollow body. In addition, the underside of the body can be perforated.

BRIEF DESCRIPTION OF THE DRAWINGS

The invention is explained further in following description based on drawings illustrating the execution.

They show.

DETAILED DESCRIPTION OF THE PREFERRED EMBODIMENT

Figure 1:
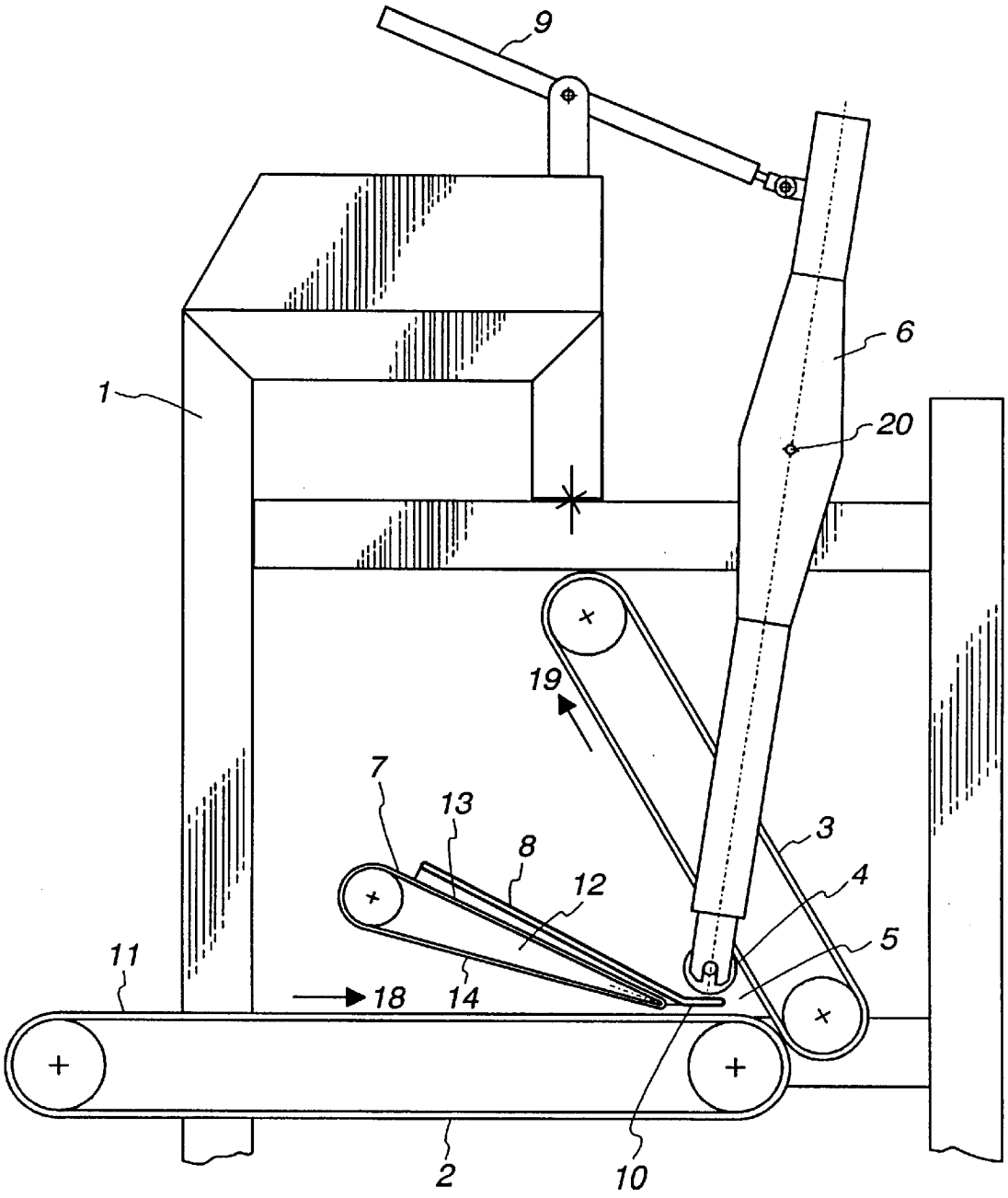
FIG. 1 illustrates a schematic view of the equipment used to roll-up a lane of compressible material in a winding process according to the principles of the present invention.

The equipment illustrated in FIG. 1 shows a machine frame 1 on which three winding elements are arranged to form a spirally formed roll of precompressed material. A first endless conveyor belt 2, as first winding element, feeds a lane 15 of compressible material into a roll. A second endless conveyor belt 3 is arranged at the end of this first endless conveyor belt at an angle of approximately 50° to 80° with the first endless conveyor belt 2. Between these two belts 2, 3, winding roller 4 is provided. The roller 4 is installed at the end of a winding arm 6 that swivels with the help of a cylinder 9 about a pivot point. Both the endless conveyor belts 2, 3 and the winding roller 4 form winding space 5. Run direction of both the endless conveyor belts 2, 3 is shown by the arrows 18, 19 respectfully.

Figure 2:
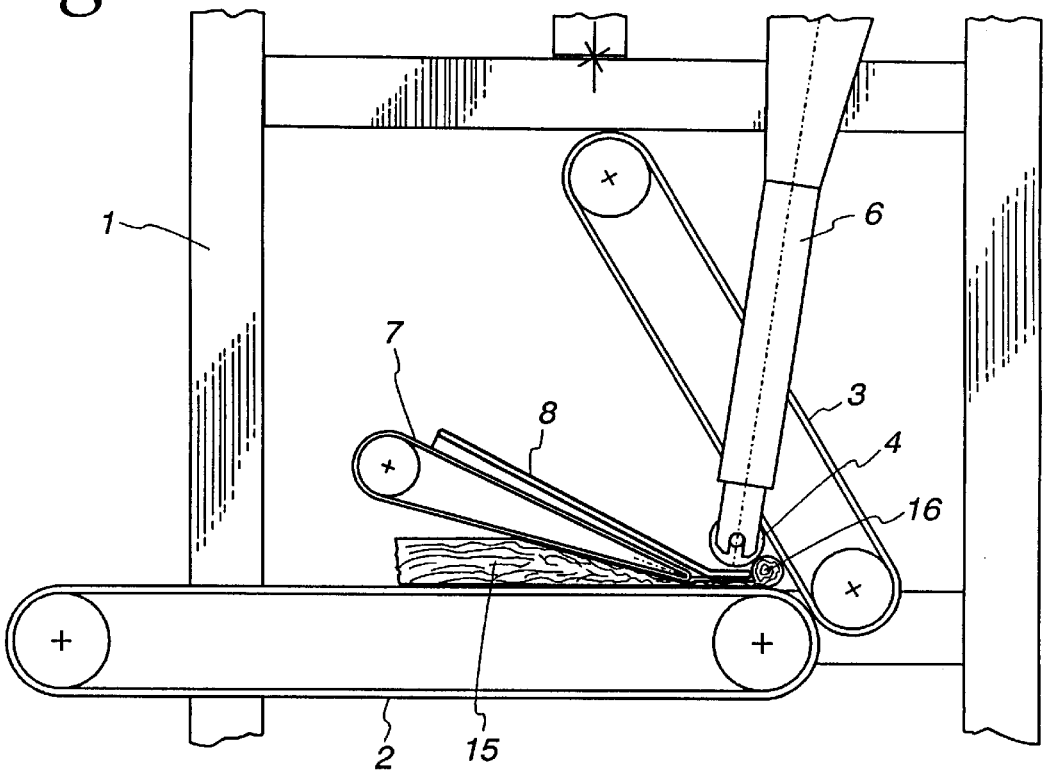
FIG. 2 illustrates a corresponding view of the machine shown in FIG. 1 at the beginning of the winding process.

Above the first endless conveyor belt 2, a third endless conveyor belt 7 is provided. One end of the third belt 7 is in direction of the winding space 5. This end of third belt 7 stops directly before the winding space 5 and the winding roller 4, respectively. The lower portion 14 of the third endless conveyor belt 7, together with the upper portion 11 of the first endless conveyor belt 2, form a V-shaped narrowing space. The lane of material is fed into the V-shaped narrowing space by the first and third belts 2,7, as seen in FIG. 2. Above the upper portion 13 of the third endless conveyor belt 7, a guide plate 8 is provided that is more or less parallel to the upper portion 13. At the end of the belt of conveyor 7, the guide plate 8 extends into a tongue 10 that runs more or less parallel to the upper portion 11 of the first endless conveyor belt 2. The tongue 10 also protrudes into the winding space 5.

The run direction 18 of the upper portion 11 of the first endless conveyor belt 2 and of the lower portion 14 of the third endless conveyor belt 7 have the same setting and run at the same speed. Furthermore, between upper and lower portions 13, 14 of the third endless conveyor belt 7, there is a V-shaped body 12 that is fitted to the geometry of conveyor belt 7. In the preferred embodiment, the endless conveyor belt 7 is functionally perforated. In addition, to divert air streaming out from the compressible material or lane 15, the body 12 is preferably formed as hollow body. Furthermore, the body 12 is perforated on its lower side. The perforations allow the air that is compressed out of the material to escape the device.

Figure 3:
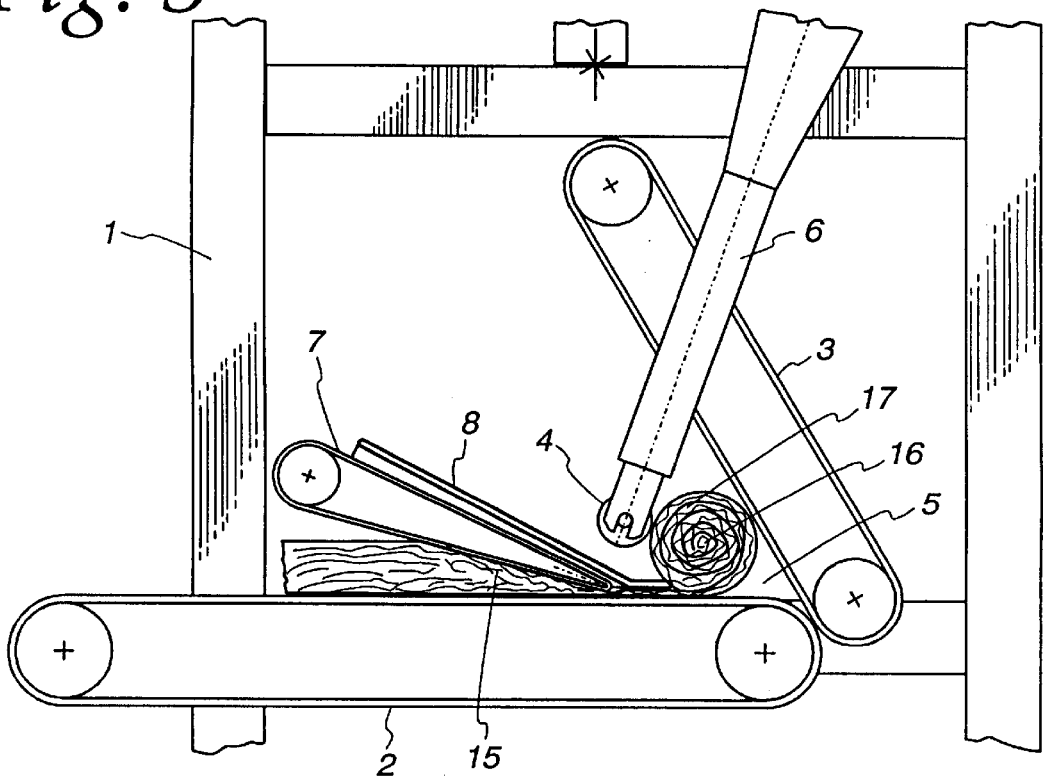
FIG. 3 illustrates a view of the machine at an advanced stage of the winding process.
Figure 4:
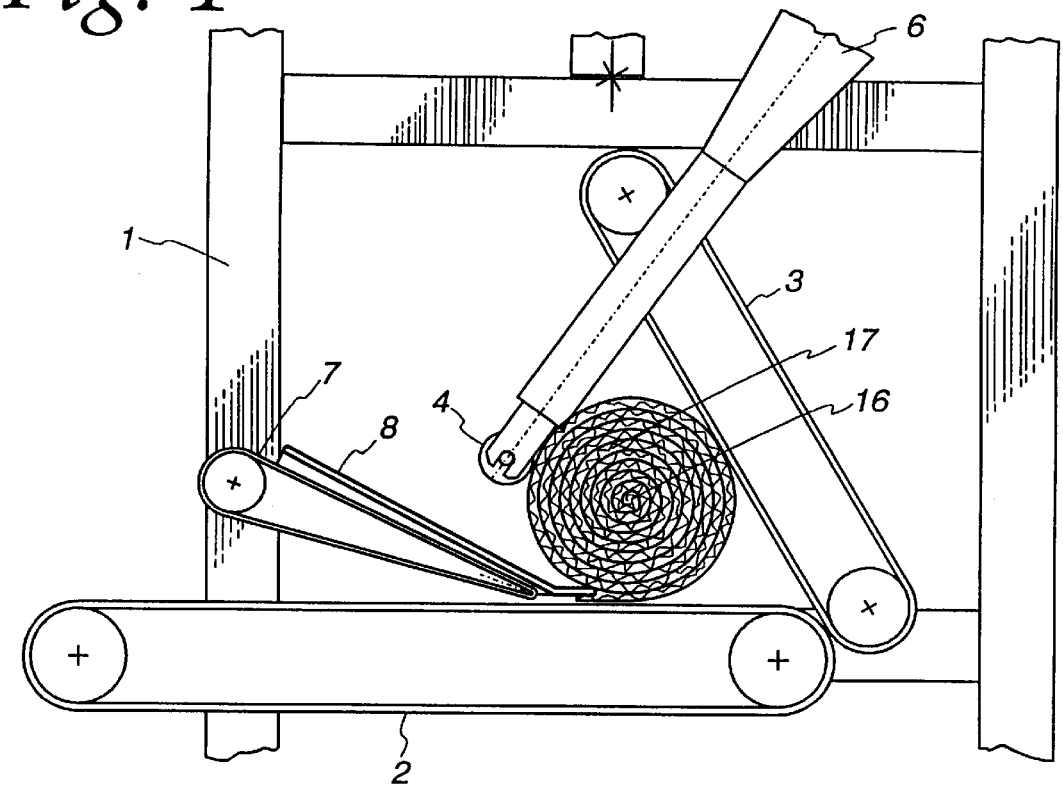
FIG. 4 illustrates a view of the equipment at the end of the winding process with the completed roll placed in the winding space.
Figure 5:
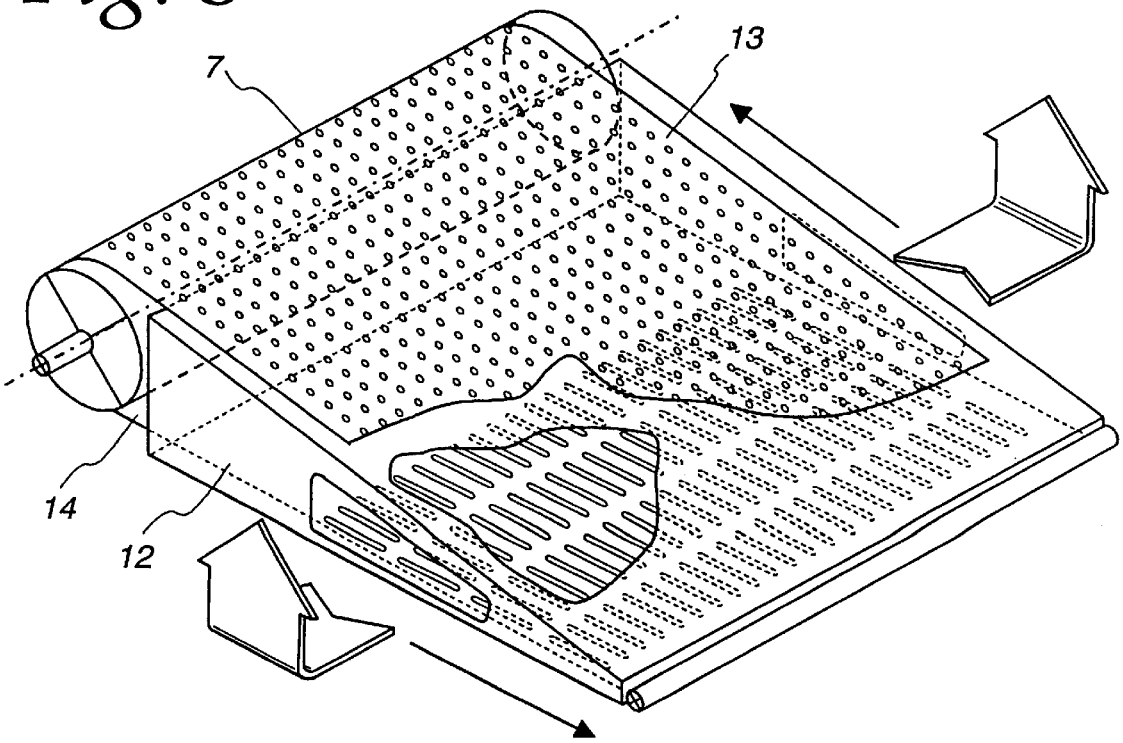
FIG. 5 illustrates a perspective view of the third conveyor belt with a cutaway portion illustrating the body between the upper and lower portions of the third conveyor belt.

As seen in FIGS. 2–4, the lane 15 fed over the first endless conveyor belt 2 is precompressed between the upper portion 11 and the lower portion 14 of the third endless conveyor belt 7 and enters the winding space 5 at the end of the tongue 10. In FIG. 2, at the beginning of the winding process, a winding core 16 is formed, whereby the contact force is set by the winding roller 4 in such a manner that the forming roller 17 is round and not deformed or crushed. The contact pressure is exerted by the swiveling winding arm 6 and the cylinder 9 over the pivot point 20.

FIG. 3 shows a forming roll 17 at an advanced stay. FIG. 4 shows the completed roll 17 with the compressed rolled lane as the consumer gets it. The end of the third endless conveyor belt 7 together with the guide plate 8 moves away from the winding roller 4 as the wind diameter of the roll 17 increases in counter run direction 18, parallel to upper portion 11 of the first endless conveyor belt 2.

What is claimed is:

1. An apparatus to roll-up a lane of compressible material during a winding process, the apparatus comprising:

a first endless conveyor belt to feed the lane which runs in a given direction and a given speed, the first belt having an upper portion and a lower portion;

a second endless conveyor belt forming an angle of between approximately 50° and 80° with the first belt;

a winding roller to hold wound material, the winding roller being arranged between the first and second belts wherein the first and second belts and the roller form a winding space and are moveable relative to one another;

a third endless conveyor belt having an upper portion and a lower portion, the lower portion running in the given direction and speed as the upper portion of the first belt wherein the first and third belts narrow to form a V-shape toward the winding space and whereby the first and third belts compress the lane of compressible material before the lane enters the winding space and move the lane of compressible material directly into the winding space; and a guide plate positioned above the upper portion of the third belt whereby the third endless belt and the guide plate move away from the winding space as the diameter of the material wound about the winding roller increases.

2. The apparatus according to claim 1 wherein the guide plate includes a tongue protruding into the winding space, the tongue being generally parallel to the upper portion of the first belt.

3. The apparatus according to claim 1 wherein the third belt includes a body positioned between the upper and lower portions of the third belt and adapted to the geometry between the upper and lower portions.

4. The apparatus according to claim 3 wherein the body is hollow.

5. The apparatus according to claim 3 wherein the body includes perforations.

6. The apparatus according to claim 1 wherein the third belt is perforated.

7. The apparatus according to claim 6 wherein the third belt includes a body positioned between the upper and lower portions of the third belt and adapted to the geometry between the upper and lower portions.

8. The apparatus according to claim 6 wherein the third belt is perforated.

9. An apparatus to roll-up a lane of compressible material during a winding process, the apparatus comprising:

a first endless conveyor belt to feed the lane which runs in a given direction and a given speed, the first belt having an upper portion and a lower portion;

a second endless conveyor belt forming an angle of between approximately 50° and 80° with the first belt;

a winding roller to hold wound material, the winding roller being arranged between the first and second belts wherein the first and second belts and the roller form a winding space and are moveable relative to one another;

a third endless conveyor belt having an upper portion and a lower portion, the lower portion running in the given direction and speed as the upper portion of the first belt wherein the first and third belts narrow to form a V-shape toward the winding space and whereby the first and third belts compress the lane of compressible material before the lane enters the winding space and move the lane of compressible material directly into the winding space;

a guide plate position above the upper portion of the third belt whereby the third endless belt and the guide plate move away from the winding space as the diameter of the material wound about the winding roller increases; and a tongue extending from an end of the guide plate and protruding into the winding space wherein the tongue is generally parallel to the upper portion of the first belt.

10. The apparatus according to claim 9 wherein the body is hollow.

11. The apparatus according to claim 9 wherein the body is perforated.

* * * * *